US009592537B2

(12) United States Patent
Bruney

(10) Patent No.: US 9,592,537 B2
(45) Date of Patent: Mar. 14, 2017

(54) RESIDUE REMOVAL DEVICE FOR NARROW NECKED VESSELS

(71) Applicant: Cecilia Bruney, Staten Island, NY (US)

(72) Inventor: Cecilia Bruney, Staten Island, NY (US)

(73) Assignee: Lia's Aesthetic Skin Therapy, LLC, Staten Island, NY (US)

( * ) Notice: Subject to any disclaimer, the term of this patent is extended or adjusted under 35 U.S.C. 154(b) by 0 days.

(21) Appl. No.: 14/793,909

(22) Filed: Jul. 8, 2015

(65) Prior Publication Data

US 2017/0008038 A1 Jan. 12, 2017

(51) Int. Cl.

| | |
|---|---|
| ***B08B 1/00*** | (2006.01) |
| ***B25G 1/04*** | (2006.01) |
| ***B25G 1/02*** | (2006.01) |
| ***B08B 9/087*** | (2006.01) |
| ***A47L 17/06*** | (2006.01) |

(52) U.S. Cl.

CPC ..... *B08B 1/005* (2013.01); *A47L 17/06* (2013.01); *B08B 9/087* (2013.01); *B25G 1/02* (2013.01); *B25G 1/04* (2013.01)

(58) Field of Classification Search

CPC ..... A47F 13/08; A47J 43/288; A47L 17/06; B08B 1/005; B08B 1/007; B08B 9/087; B08B 9/0808; B25G 1/02; B25G 1/04

USPC ..... 294/176, 180; 15/236.01, 236.07, 236.09

See application file for complete search history.

(56) References Cited

U.S. PATENT DOCUMENTS

| | | | | | |
|---|---|---|---|---|---|
| 2,630,591 | A | * | 3/1953 | Smith | A47J 43/282 15/105 |
| 2,634,497 | A | * | 4/1953 | Waldesbuehl | A47G 21/04 15/236.08 |
| D232,068 | S | * | 7/1974 | Hager | 30/142 |
| D236,074 | S | | 7/1975 | Monagle | |
| 4,381,576 | A | | 5/1983 | Nishikawa | |
| D278,402 | S | | 4/1985 | Reichard | |
| 4,627,128 | A | | 12/1986 | Shea | |
| 4,674,186 | A | * | 6/1987 | Galiano | B44D 3/162 15/236.07 |
| 4,987,635 | A | | 1/1991 | Young | |
| 5,291,992 | A | | 3/1994 | Olivetti | |
| 5,345,642 | A | | 9/1994 | Faldetta | |
| 5,601,322 | A | * | 2/1997 | Forest | A01K 63/006 15/105 |
| 5,706,546 | A | | 1/1998 | Utley | |
| 5,799,997 | A | * | 9/1998 | Lehn | A47L 13/022 15/236.07 |

(Continued)

*Primary Examiner* — Dean Kramer

(74) *Attorney, Agent, or Firm* — Lerner, David, Littenberg, Krumholz & Mentlik, LLP

(57) ABSTRACT

The present disclosure relates to a residue removal device for extracting leftover material from a narrow-necked vessel. The residue removal device may include a receptacle adapted for collecting material from sides and bottom of a vessel. The receptacle may include a material collecting channel formed by two side walls connected along a base at an angle, an open top, a distal end, and a proximal end. The residue removal device may further include an elongated shaft having a proximal end and a distal end, and the distal end of the shaft may be connected to the base of the receptacle and offset in a first direction from the proximal end of the shaft. The open top may also be offset from the base of the receptacle in the first direction.

23 Claims, 8 Drawing Sheets

(56) References Cited

U.S. PATENT DOCUMENTS

| | | | | |
|---|---|---|---|---|
| 5,875,515 | A * | 3/1999 | Dallas | A47J 43/288 15/236.01 |
| 7,182,377 | B2 | 2/2007 | Grundler | |
| D631,306 | S | 1/2011 | Capaul et al. | |
| D750,837 | S * | 3/2016 | Gast | D28/57 |
| 2009/0293898 | A1 | 12/2009 | Young | |
| 2010/0229319 | A1 * | 9/2010 | Phillips | A45D 40/26 15/236.09 |
| 2012/0280525 | A1 | 11/2012 | Tharp | |
| 2013/0313847 | A1 * | 11/2013 | Tortatice | B25J 11/00 294/209 |
| 2014/0143957 | A1 * | 5/2014 | Gattineri | A47J 43/288 7/110 |

* cited by examiner

RESIDUE REMOVAL DEVICE FOR NARROW NECKED VESSELS

FIELD OF THE INVENTION

The present disclosure relates to a residue removal device for removing leftover material residue from narrow necked vessels.

BACKGROUND OF THE INVENTION

Viscous products such as condiments in the food industry or lotions and cosmetics used in the personal care and cosmetic industries are typically provided in bottles, vials, jars, tubes, or other vessels with narrow necks. When most of the contents of such a container have been dispensed, it is often difficult or impossible to remove the remaining material using available tools such as spoons, knives, spatulas, or similar items. A considerable amount of product therefore always remains in the vessel and is discarded, thereby wasting a substantial amount of good, useable product.

Past known devices have provided various solutions for removing materials from the interior wall or bottom section of such containers. U.S. Pat. No. 4,627,128 and U.S. Pat. No. 4,987,635 are generally designed with lower blade members that are only used with cylindrically shaped containers. Other devices offer blade members designed for scraping the walls of cylindrical containers of a specific size, as in U.S. Pat. No. 5,345,642.

Some devices are simply not effective as disclosed. U.S. Design Pat. No. D278402 discloses a bottle spoon, but the receptacle portion of the spoon is small, and does not disclose a handle that may be appropriately shaped to scrape leftover material on the side of a bottle, as the handle appears to have a width that is equivalent to the width of the receptacle portion of the spoon. Additionally, the top of the receptacle is flush with the top of the handle portion, also potentially hindering effective gathering of material from the side of a container. Some of the disclosed devices, such as the device disclosed in U.S. Pub. No. 2012/0280525, have very small receptacles, and the device would have to be inserted into a bottle many times in order to remove a substantial and usable amount of product.

Other devices can scrape the interior walls of a variety of containers, but fail to provide a means to efficiently clean materials from the bottom section of the container, or do not provide support for the contents of the receptacle during removal from the vessel. U.S. Pat. No. 4,381,576 discloses such a utensil. Additionally, the patent does not disclose a handle that may have an offset to facilitate removal of residue from the sides of a container.

Other potential solutions include chemically coating the interior of containers with materials that prevent residue from sticking to the container walls. However such materials have yet to be proven safe and effective with varying container surfaces and with products in the food or personal care and cosmetic industries.

Accordingly, a need exists for a tool or a device that can be used to recover leftover material in vessels having narrow openings.

SUMMARY OF THE INVENTION

One aspect of the present disclosure provides a residue removal device for extracting leftover material from a vessel. The device is adapted for removing material residue in a narrow necked vessel. The device comprises a receptacle adapted for collecting material from the sides and bottom of a vessel, and an elongated shaft connected to the receptacle.

The receptacle comprises a material collecting channel formed by two side walls connected along one side at an angle, a distal end, and a proximal end. In some embodiments, the receptacle may have rounded corners. The material collecting channel may have a shape selected from a semi-circle, a semi-oval, a U-shape, a V-shape, a V-shape having a flat base, a U-shape having a flat base, a modified D-shape with an open top, and an open wedge shape with slanted side walls. At least one side wall of the receptacle may be adapted to be placed against, and dragged along the inside surface of a vessel to collect material caught on the inside surface of the vessel. A top edge of at least one side wall of the receptacle may be flexible and resilient. In some embodiments, the material collecting channel further comprises an end wall on an end of the material collecting channel. The receptacle may be made of at least one of plastic, rubber, silicone, polyethylene, propylene, metal, alloy, shape memory alloy, and combinations thereof.

The receptacle also comprises an elongated shaft having a proximal end and a distal end, wherein the distal end of the shaft is connected to the receptacle. In some embodiments, the shaft is straight. In other embodiments, the shaft is telescoping. In yet other embodiments, the shaft is extended by means of one or more connectable sections. The shaft may also be flexible. In some embodiments, the shaft comprises a user-bendable section. The shaft may also comprise an offset section. In some embodiments when the shaft comprises an offset section, the offset section places the proximal end of the shaft in a line approximately parallel and below the bottom edge of the receptacle. The offset distance may be approximately 90 to 110% of the depth of the receptacle.

The shaft may comprise a handle on the proximal end. In some embodiments when the shaft comprises a handle, the handle comprises at least one of a circular and semicircular pattern thereon. The proximal end of the shaft may also comprise at least one of an opening, a notch, and a ring-shaped attachment for storage of the device.

The shaft may be fixedly connected to the receptacle. Alternatively, the shaft may be removably connected to the receptacle. In some embodiments when the shaft is removably connected to the receptacle, the shaft may comprise coupling means for removably connecting the shaft to the receptacle.

The residue removal device may further comprise a residue recovery tool, wherein the residue recovery tool is an elongated member with a distal end and a proximal end. The tool comprises a recovery end at the distal end, wherein the recovery end has a size and shape substantially complementary to the cross-sectional size and shape of a material collecting channel in a residue removal device. The recovery tool may further comprise a recovery end at the proximal end having a different shape and size than the recovery end at the distal end. Alternatively, the recovery tool comprises a handle at the proximal end. In some embodiments when the recovery tool comprises a handle at the proximal end, the recovery tool may comprise a handle comprising an opening or notch for storage of the tool. The recovery tool may further comprise a circular shape having at least one of a circular and semicircular pattern thereon to guide the selection of an appropriately sized receptacle.

One aspect of the present disclosure provides a residue removal kit for extracting leftover material from a vessel.

The kit comprises a plurality of receptacles have varying configurations. The receptacles and the varying configurations of receptacles may be as described above. The kit also comprises a plurality of elongated shafts having varying configurations. The shafts and the varying configurations of shafts may be as described above.

In some embodiments, the kit further comprises a plurality of residue recovery tools have varying configurations. The residue recovery tools and the varying configurations of residue recovery tools may be as described above.

BRIEF DESCRIPTION OF THE DRAWINGS

The following drawings form part of the present disclosure and are included to further demonstrate certain aspects of the present disclosure. The disclosure may be better understood by reference to one or more of these drawings in combination with the detailed description of specific aspects presented herein. The drawings are not to scale.

DETAILED DESCRIPTION

Figure 1A:
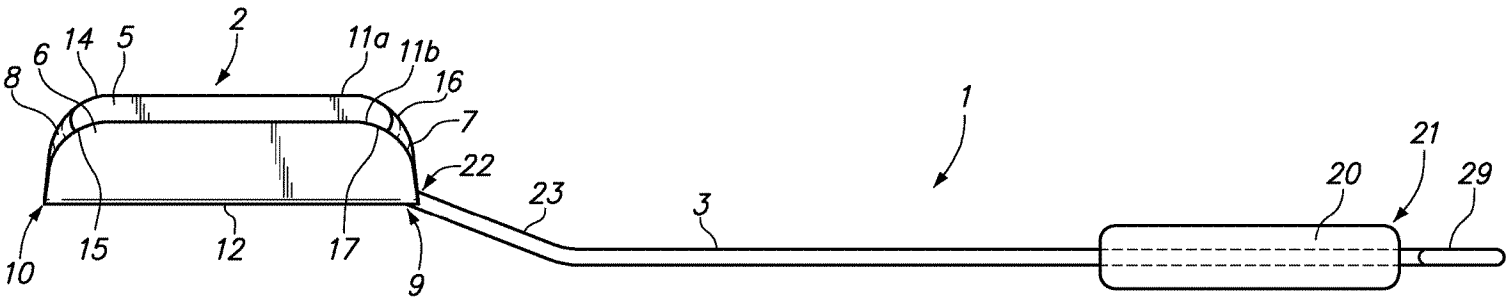
FIG. 1 depicts (A) a left side view of an embodiment of the residue removal device having end walls, (B) a perspective top front view of an embodiment of the residue removal device having end walls, (C) a top view of an embodiment of the residue removal device having end walls, (D) a left side view of an embodiment of the residue removal device having end walls and a circular or semicircular pattern on the handle, and (F) a left side view of an embodiment of the residue removal device having a proximal end wall.
FIG. 1B depicts a perspective top front view of an embodiment of the residue removal device having end walls, wherein the ring-shaped attachment is thin.
FIG. 1C depicts a top view of an embodiment of the residue removal device having end walls, wherein the ring-shaped attachment is thin.
FIG. 1D depicts a left side view of an embodiment of the residue removal device having end walls and a circular or semicircular pattern on the handle.
FIG. 1E depicts a top view of an embodiment of the residue removal device having end walls, wherein the ring-shaped attachment is thick.

As required, detailed embodiments of the present inventions are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

In the drawings and the description which follows, the term "proximal" will refer to the end of the apparatus which is closest to the operator while the term "distal" will refer to the end which is furthest from the operator.

The subject invention shall be discussed in terms of a residue removal device adapted for extracting leftover material from narrow necked vessels. Such vessels typically range in size from as little as one-half ounce (~14.8 mL) to as large as one gallon (~3.8 L), with vessels of one ounce (~29.6 mL) to 32 ounces (~946 mL) being common for use in cosmetics, personal care products, etc., although the device described herein may be suitable for vessels of smaller or larger sizes. The neck size of a vessel is typically described by its diameter measured in millimeters, with common sizes ranging from 18 mm to 28 mm, usually in two millimeter increments. The residue removal device described herein is particularly well suited for use in a vessel having a base diameter of between approximately two to three times the size of the neck opening. For instance, common sized bottles used for personal care products have bases of approximately 45-90 mm with neck sizes of 24-28 mm and a volume, depending on their height, of up to 32 ounces. Such bottles are usually no taller than 10 inches, with 8 to 9½ inches being common. Smaller sized bottles for which the residue removal device is also suited have a capacity of approximately 2-12 ounces (for example, a 3-ounce travel-size bottle), a base width of approximately 30-60 mm and neck size of 20-24 mm. The residue removal device may be used in vessels of varying cross-sectional shape including circular, oval, Boston round, Boston squat, wide-shouldered, and oblong or oval tottle, among others.

An embodiment of the residue removal device 1 is shown in FIGS. 1A-1E. The residue removal device comprises a receptacle 2 for collecting material from the sides and bottom of a vessel, and an elongated shaft 3 having one end connected to the proximal end of the receptacle 2.

Figure 1B:
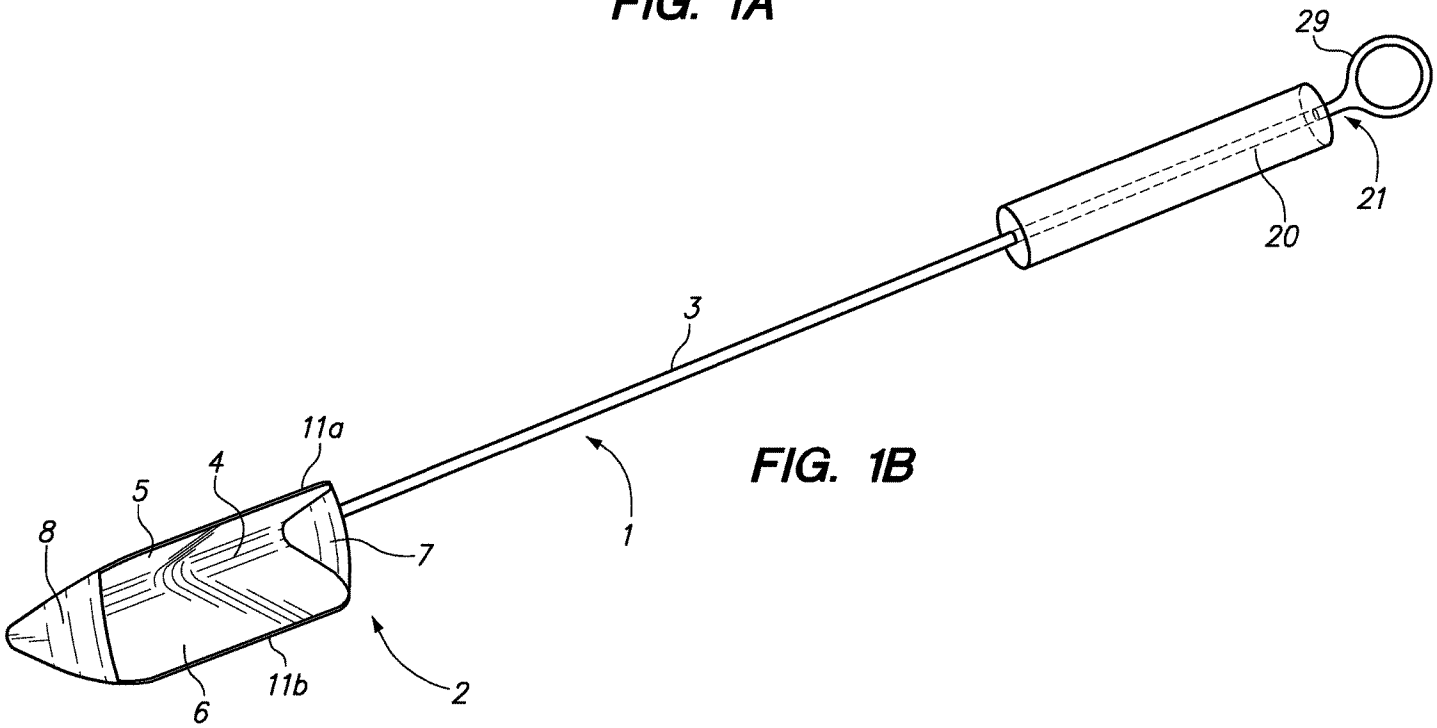
Figure 1C:
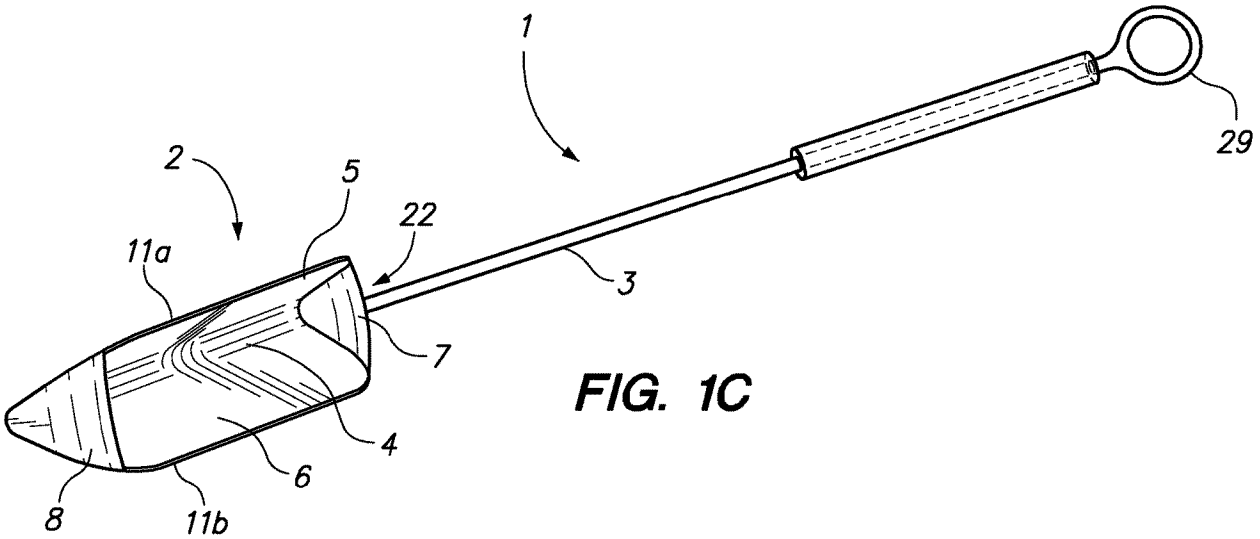
Figure 1D:
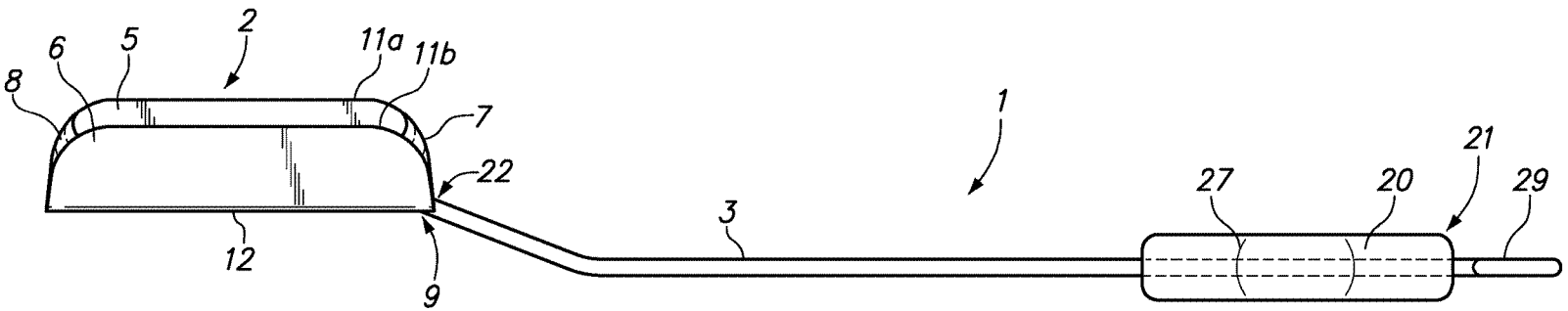
Figures 1E, 2A, 2B, 2C, 2D, 2E, 2F:
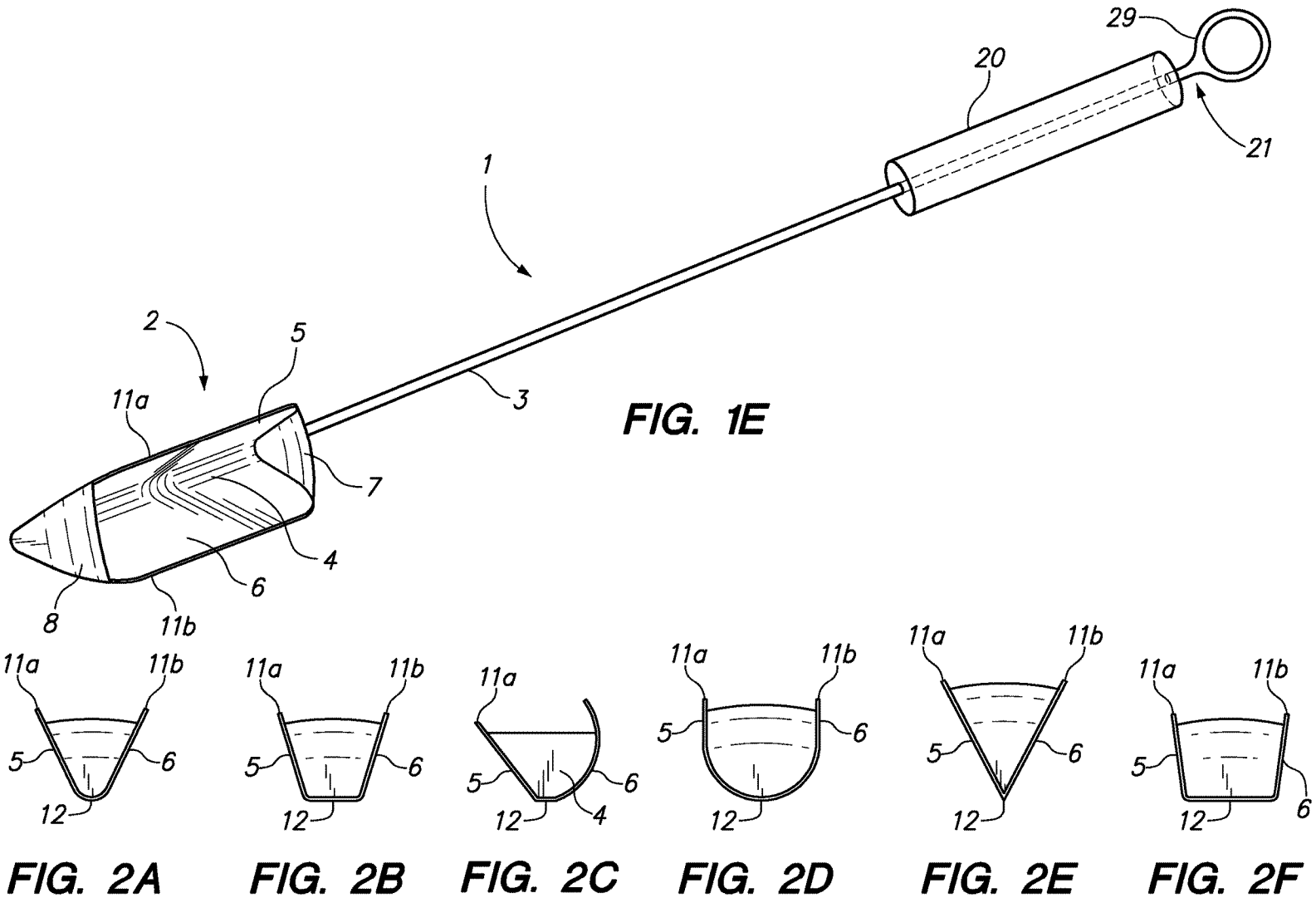
FIG. 2A depicts a cross-sectional view of a receptacle having a V-shape with rounded base.
FIG. 2B depicts a cross-sectional view of a receptacle having a V-shape with flat base.
FIG. 2C depicts a cross-sectional view of a receptacle having a modified D cross-sectional shape.
FIG. 2D depicts a cross-sectional view of a receptacle having a U-shape.
FIG. 2E depicts a cross-sectional view of a receptacle having a V-shape.
FIG. 2F depicts a cross-sectional view of a receptacle having a substantially rectangular shape with an open top.

The receptacle 2 comprises a material collecting channel 4 formed by sidewalls 5 and 6 connected at an angle along one side. As described above, the receptacle 2 is adapted for collecting material from the sides and bottom of a vessel. As such, at least one of the side walls of the receptacle 2 is adapted to be placed against, and dragged along the inside surface of the vessel to scrape and collect material caught on the inside surface of the vessel. A sidewall adapted to scrape material may be flat or curved and comprises a straight scraping edge. FIGS. 1A-1E and FIGS. 3A-3C show embodiments wherein both sidewalls are adapted for scraping the sides of the vessel showing flat side walls 5 and 6 and straight edges 11*a* and 11*b* for scraping. In this manner, residue can be collected by scraping the side walls of the vessel in both a clockwise and counter-clockwise motion. FIG. 2C shows a cross-sectional view of an embodiment wherein only one sidewall 5 is adapted for scraping the sides of the vessel showing planar side wall 5, curved side wall 6, and straight edge 11*a* for scraping. The top corners 14, 15, 16, and 17 of the sidewalls 5 and 6 can be straight or rounded. Preferably, the top corners 14, 15, 16, and 17 are rounded for smooth insertion and removal of the receptacle 2 through a narrow vessel opening and to fit the rounded corners at the base of a vessel.

The cross-sectional shape of the material collecting channel 4 may be a semi-circle, semi-oval, a U-shape (FIG. 2D), a V-shape (FIG. 2E), a V-shape with a flat (FIG. 2B) or rounded base (FIG. 2A), a U-shape with a flat base, a modified D-shape with an open top (FIG. 2C), a rectangular or substantially rectangular shape with an open top (FIG. 2F), or an open wedge shape with slanted side walls. Other cross-sectional shapes may also be envisioned to conform to the shape of the receptacle channel.

The receptacle 2 may further comprise an end wall 7 on the proximal end 9 of the receptacle 2 and/or an end wall 8 on the distal end 10 of the receptacle 2. End walls 7 and 8 may be useful when the leftover material being scraped is more fluid, providing support for the material during removal from the vessel. Additionally, end wall 8 on the distal end 10 of the receptacle 2 may also be useful for scraping material at the bottom of the vessel. An embodiment of the device 1 shown in FIGS. 1A-1E comprises a receptacle 2 having an end wall 7 on the proximal end 9 and an end wall 8 on the distal end 10. An embodiment of the device 1 shown in FIG. 1F comprises a receptacle 2 having an end wall 7 on the proximal end 9. An embodiment of the device 1 shown in FIGS. 3A-3C comprise a receptacle 2 without end walls. Other embodiments wherein the receptacle 2 comprises only one end wall on either the distal end 10 or the proximal end 9 of the receptacle 2 may also be envisioned. The height of an end wall on the proximal end 9 or the distal end 10 of a receptacle 2 may be equal to the height of the sidewalls 5 and 6. Alternatively, an end wall on the proximal end 9 or the distal end 10 of a receptacle 2 may preferably be shorter than the height of the sidewalls 5 and 6 so as to facilitate passage of the receptacle through the neck of the vessel. Additionally, the one or more end walls may generally follow the contours of the side walls and base of the receptacle (e.g. a U-shaped end wall for a U-shaped receptacle, a V-shaped end wall for a V-shaped receptacle, etc.). As shown in FIGS. 1A-1F, in an embodiment when the receptacle 2 has rounded corners, the one or more end walls may be curved to follow the contours of the side walls. The end wall is preferably formed from a flexible material that allows it to flex outwardly from the receptacle when the receptacle is being manipulated through the narrow neck of a vessel and return to its straightened position within or outside of the vessel.

The receptacle 2 may be made from any material or combination of materials suitable for making the receptacle 2 adapted for collecting leftover material from the sides and bottom of a vessel. Non-limiting examples of suitable materials include plastics, rubbers, silicones, polyethylenes, propylenes, metals, and combinations thereof. It should be recognized that different parts of the receptacle 2 may be formed from different material or combination of material. For instance, the base 12 of the receptacle 2 may be made of reinforced material such as metal or reinforced plastic to lend strength and rigidity to the receptacle 2 during scraping, whereas the one or more sidewalls of the receptacle 2 may be formed from flexible and resilient material such as silicone, rubber, or plastic in order to allow the edge 11*a* and/or 11*b* of a sidewall to conform to the inside surface of the vessel to scrape the material therefrom. Other embodiments where edges 11*a* and 11*b* of sidewalls 5 and 6 are formed from different materials than the one or more sidewalls may also be envisioned. Preferably, the base 12 of the receptacle 2 is made from reinforced material, and at least one sidewall is adapted for scraping and is made of flexible and resilient material. More preferably, the base 12 of the receptacle 2 is made of reinforced material, and both sidewalls 5 and 6 are adapted for scraping and are made of flexible and resilient material. When the receptacle 2 further comprises one or more end walls 7 and 8, one or both end walls are generally made from a material having sufficient flexibility to allow their adjacent sidewalls 5 and 6 to fit through the narrow neck of the vessel in which the device is being used.

The size of the receptacle 2 can and will vary depending on the size of the vessel opening in which the device 1 will be used. As such, an array of devices having varying receptacle sizes may be envisioned, wherein the size of each receptacle 2 is adapted to access an equivalent range of vessel opening sizes. In general, the receptacle 2 is sized so as to fit through the neck opening of the vessel for which it is designed, where the device will be used to allow for insertion of the receptacle 2 into the vessel. For instance, the size of the receptacle 2 can be smaller or substantially equal to the size of the vessel opening in which the device 1 will be used. Additionally, when the sidewalls 5 and 6 of the receptacle 2 are made of flexible and resilient material, the size of the receptacle 2 can be somewhat larger than the size of the vessel opening in which the device 1 will be used as the flexible material allows the receptacle 2 to be squeezed through a smaller vessel opening.

The shaft 3 of a residue removal device 1 is generally an elongated member having a proximal end 21 and a distal end 22. As it will be recognized, the shaft 3 should be sufficiently long to allow the receptacle 2 to reach material at the bottom of vessels of varying depths. An array of devices having varying shaft lengths to access a range of vessel sizes may also be envisioned. The shaft 3 may be telescoping to accommodate vessels of varying depths. Alternatively, the shaft 3 may be extended by means of one or more connectable sections. The shaft 3 should be sufficiently rigid to provide support during use of the device 1, but may also be bendable or flexible enough to be manipulated by the user to reach the interior walls of different vessels. The shaft 3 may be round, flat, rectangular, triangular, or any other shape suitable for providing the necessary rigidity and support during use of the device 1 and may be either solid or hollow in cross-section. The shaft 3 may be made from any material or combination of materials suitable for providing the necessary rigidity, flexibility, and support during use of the device 1. Non-limiting examples of suitable materials include plastics, rubbers, silicones, polyethylenes, propylenes, metals, alloys, shape memory alloys and combinations thereof.

Figure 3A:
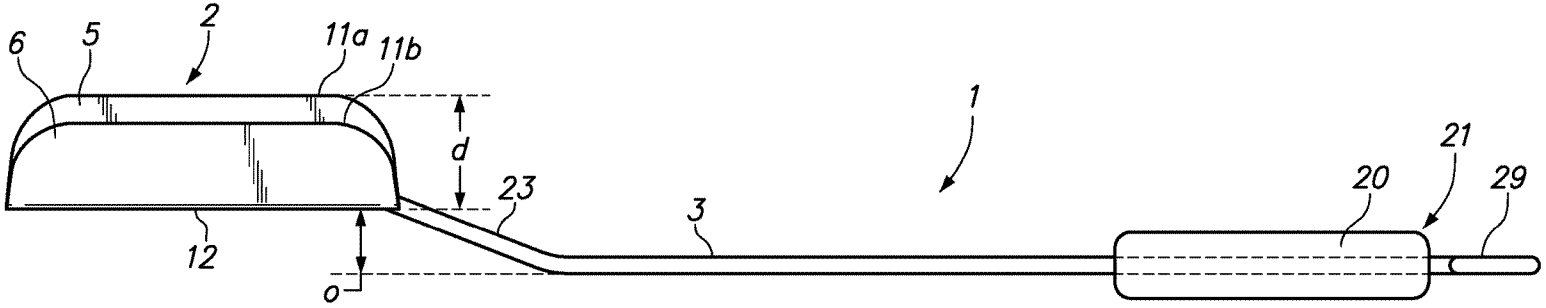
FIG. 3A depicts a left side view of an embodiment of the residue removal device that does not have end walls.
Figure 3B:
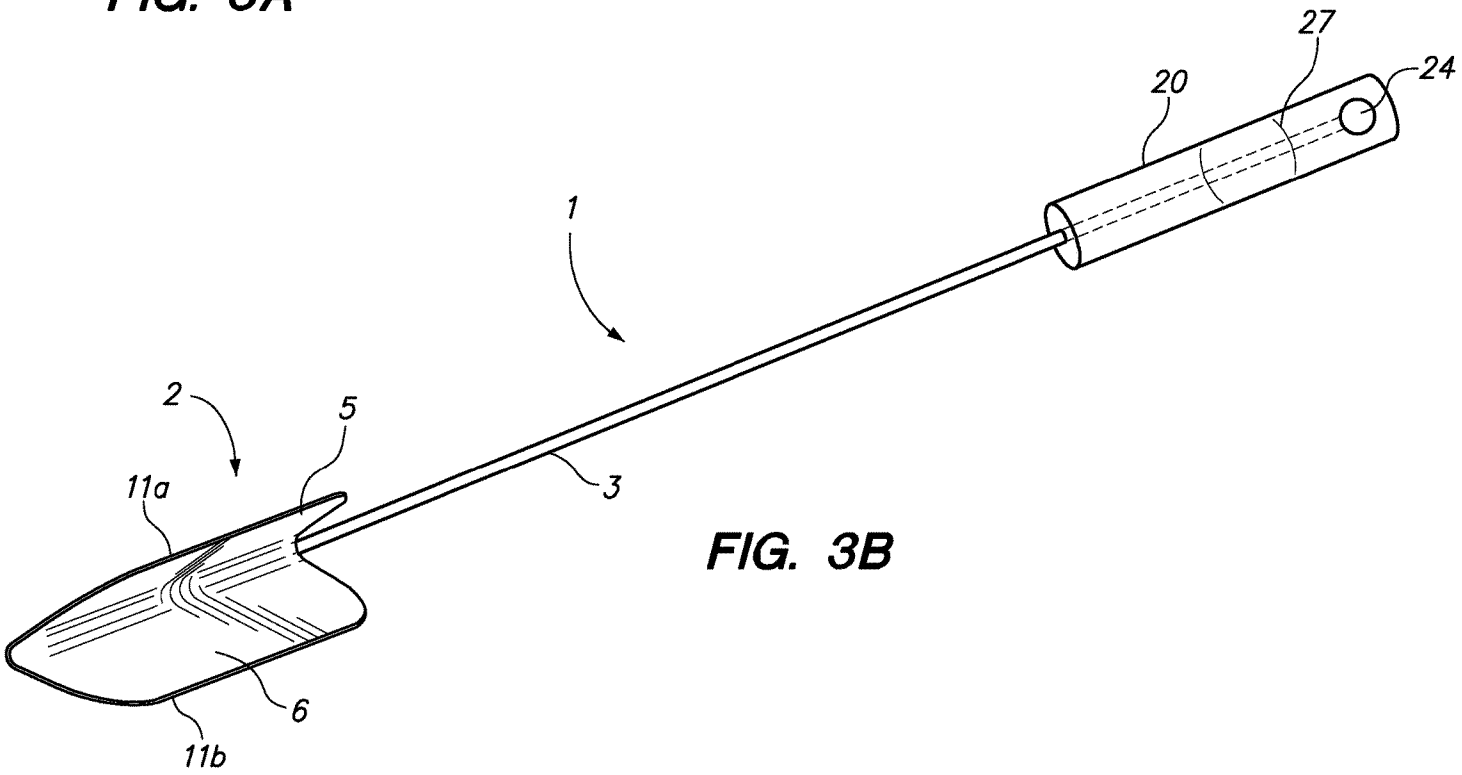
FIG. 3B depicts a perspective top front view of an embodiment of the residue removal device that does not have end walls, and that has a notch in the handle.

In some embodiments, the shaft 3 comprises a handle 20 at the proximal end 21 of the shaft. The handle 20 may be molded or covered with a material for comfortable but rigid and durable use of the device 1, for example, molded plastic to withstand frequent washing. In one embodiment, the handle may further comprise a circular or semicircular pattern 27 drawn or etched thereon corresponding to the particular neck size for which the device is designed. The pattern 27 can be used to measure the opening on a vessel to guide the user while selecting an appropriately sized receptacle 2. FIGS. 1D and 3B show embodiments of the device 1 comprising a circular or semicircular pattern 27 drawn or etched on the handle 20.

Figure 3C:
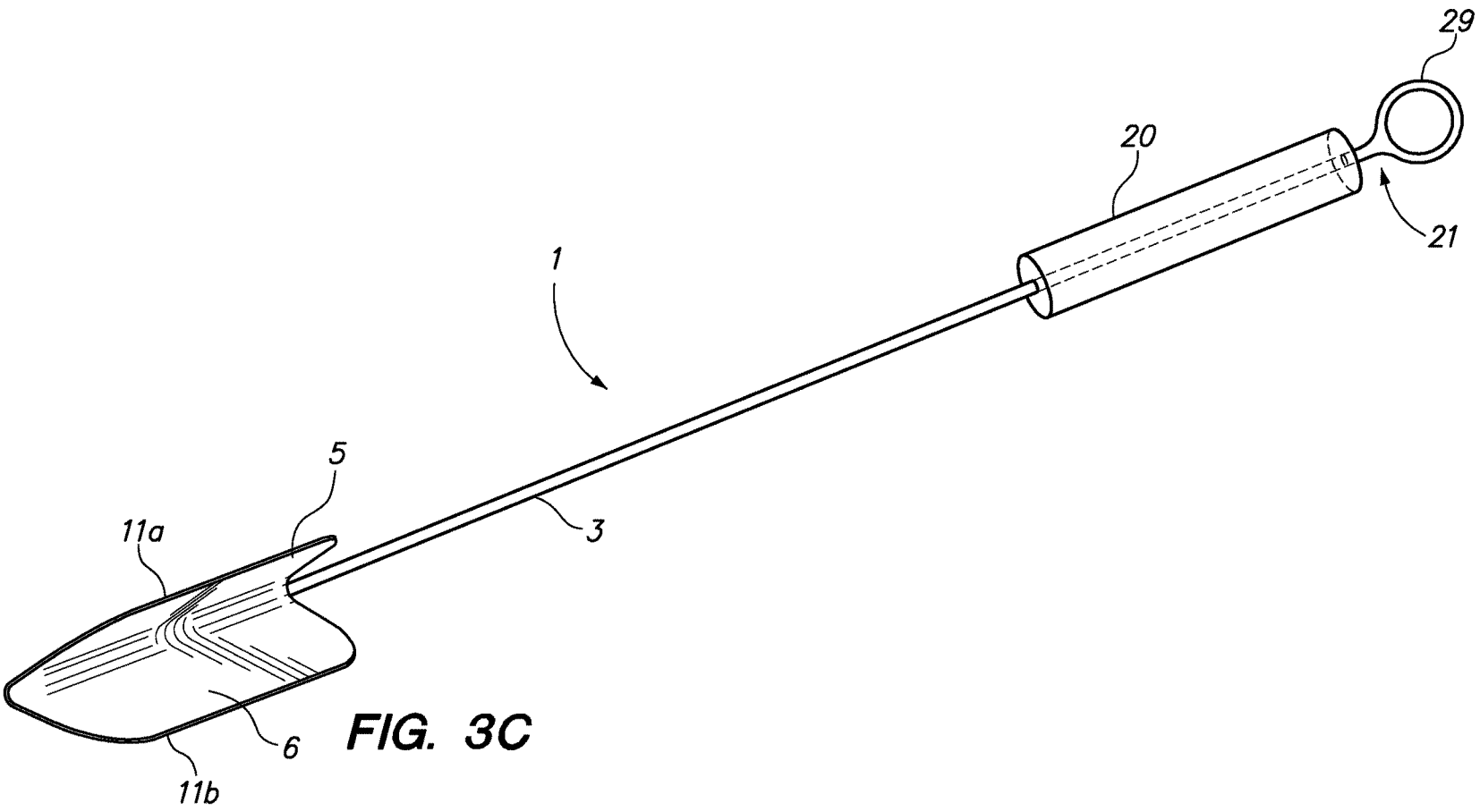
FIG. 3C depicts a perspective top front view of an embodiment of the residue removal device that does not have end walls, has an opening in the handle, and wherein the opening is a thin ring-shaped attachment.

In some embodiments, the proximal end 21 of the shaft 3 may comprise an opening, hook, or notch 24 to permit hanging storage of the device 1. In one embodiment, the opening or notch 24 is in the handle 20 as shown in an embodiment of the device 1 in FIG. 3B. In another embodiment, the opening 24 is a ring-shaped attachment 29 at the proximal end 21 of the shaft 3. FIGS. 1A-1E and 3C show an embodiment of device 1 wherein the opening 24 is ring-shaped. The ring-shaped attachment 29 may have varying thicknesses for decorative and utilitarian purposes. FIGS. 1B, 1C, and 3C show embodiments wherein the ring-shaped attachment 29 is thin, whereas FIG. 1E shows an embodiment wherein the ring-shaped attachment 29 is thick. In addition to permitting storage of the device 1, the opening 24 may be used as a measuring device to guide the user while selecting an appropriately sized receptacle 2. In one embodiment, the opening 24 is a ring-shaped measuring device having a circumference equivalent to the opening on a vessel to guide the user while selecting an appropriately sized receptacle 2. In another embodiment, the handle 20 includes a notch or opening 24 used for storage of the device as well as a circular or semicircular pattern 27 drawn or etched thereon to guide the user while selecting an appropriately sized receptacle 2 for the given vessel size.

In some embodiments, the shaft 3 is straight. Preferably, the shaft 3 comprises an offset section 23. Even more preferred is a shaft 3 comprising an offset section 23 wherein the offset section 23 places the grasping end of the shaft in a line approximately parallel to and below the bottom edge of the receptacle 2. Preferably, the offset distance o is approximately 90 to 110% of the depth of the receptacle d, although greater or lesser offsets can be employed without departing from the scope of the invention. Embodiments of the device 1 having an offset section 23 placing the grasping end of the shaft in a line roughly parallel to and below the bottom edge of the receptacle 2 are shown in FIGS. 1A-1E, 3A-3C, and 4A-4B. Such an offset may facilitate operation of the residue removal device 1 during scraping of the vessel by placing a scraping edge 11*a* or 11*b* of the receptacle 2 into direct, flat contact with the side of a vessel. The offset section 23 may be anywhere along the length of the shaft 3. Preferably, the offset section 23 is at or near the distal end 22 of the shaft 3.

The shaft 3 may further comprise a bendable section. A bendable section may be used to introduce one or more bends into the shaft 3 to facilitate operation of the residue removal device 1 during scraping of the vessel.

The distal end 22 of the shaft 3 is fixedly or removably connected to the receptacle 2. The shaft 3 may be connected at any point along the receptacle 2. Preferably, the shaft 3 is connected to the proximal end 9 of the receptacle 2 at the base 12 of the receptacle.

In some embodiments, the shaft 3 is fixedly connected to the receptacle 2. In other embodiments, the shaft 3 is removably connected to the receptacle 2. Removably connecting the shaft 3 to the receptacle 2, can provide flexibility for quickly replacing a receptacle when a fresh clean receptacle is needed, to match the desired length of a shaft 3 with the desired size of a receptacle 2 to facilitate access to a range of vessel and opening sizes, or to add or remove a shaft extension section as needed.

Figure 4A:
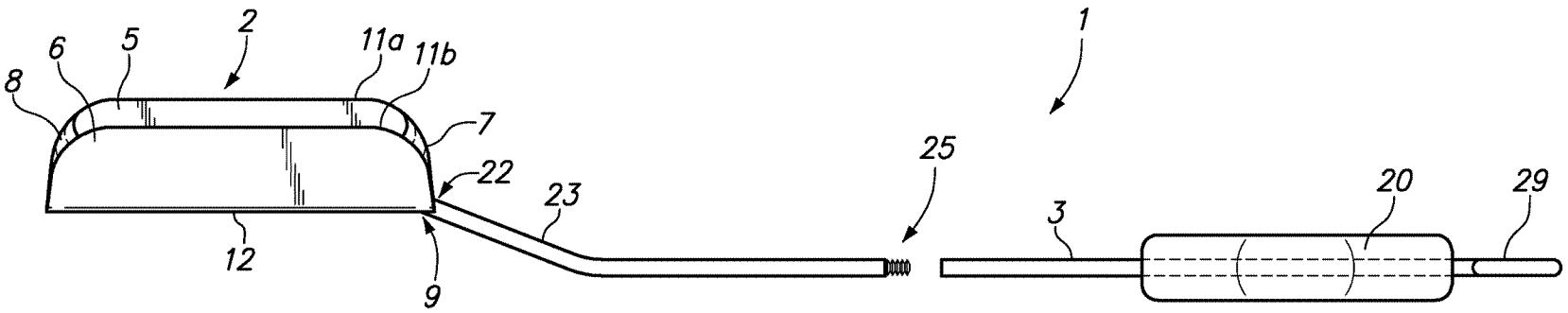
FIG. 4A depicts a left side view of an embodiment of the residue removal device with end walls and a threaded coupling means.
Figure 4B:
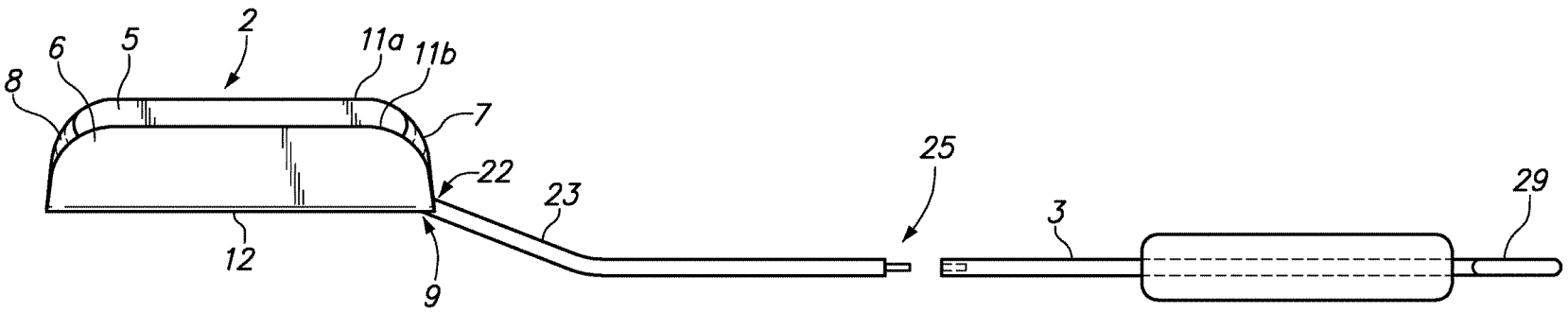
FIG. 4B depicts a left side view of an embodiment of the residue removal device with end walls and a force-fitting coupling means.

The shaft 3 may be removably connected to the receptacle 2 through coupling means 25. The coupling means 25 may be anywhere along the length of the shaft 3. FIGS. 4A-4B show embodiments wherein the coupling means 25 is in an area between the handle 20 and an offset section 23 of the shaft 3. Any means suitable for coupling the shaft 3 to the receptacle 2 may be used in the device 1. Non-limiting examples of suitable coupling means include a threaded coupling means, or force-fitting means. FIG. 4A shows an embodiment wherein the coupling means 25 is a threaded coupling means in an area between the handle 20 and an offset section of the shaft 3. FIG. 4B shows an embodiment wherein the coupling means 25 is a force-fitting coupling means in an area between the handle 20 and an offset section of the handle 3.

Referring now to FIGS. 5A-5E, the residue removal device 1 may further comprise a residue recovery tool 30. The residue recovery tool 30 is used to gather the contents in the receptacle 2 after residue has been collected from a vessel using the device 1. The residue recovery tool 30 is generally an elongated substantially flat member with a distal end 31 and a proximal end 32. The distal end 31 comprises a recovery end 33. The recovery end 33 has a size and shape substantially complementary to the cross-sectional size and shape of the material collecting channel 4 in the receptacle of the device 1 and is configured to scrape and recover residue collected in the channel 4 for further use. Therefore, the size and shape of the recovery end 33 of a residue recovery tool 30 can and will vary depending on the size and shape of the receptacle 2 with which the recovery tool 30 will be used. As such, an array of recovery tools having varying recovery end 33 sizes and shapes may be envisioned, wherein the size and shape of each recovery end 33 is adapted to access an equivalent range of channel sizes and shapes.

Figures 5A, 5B, 5C, 5D, 5E:
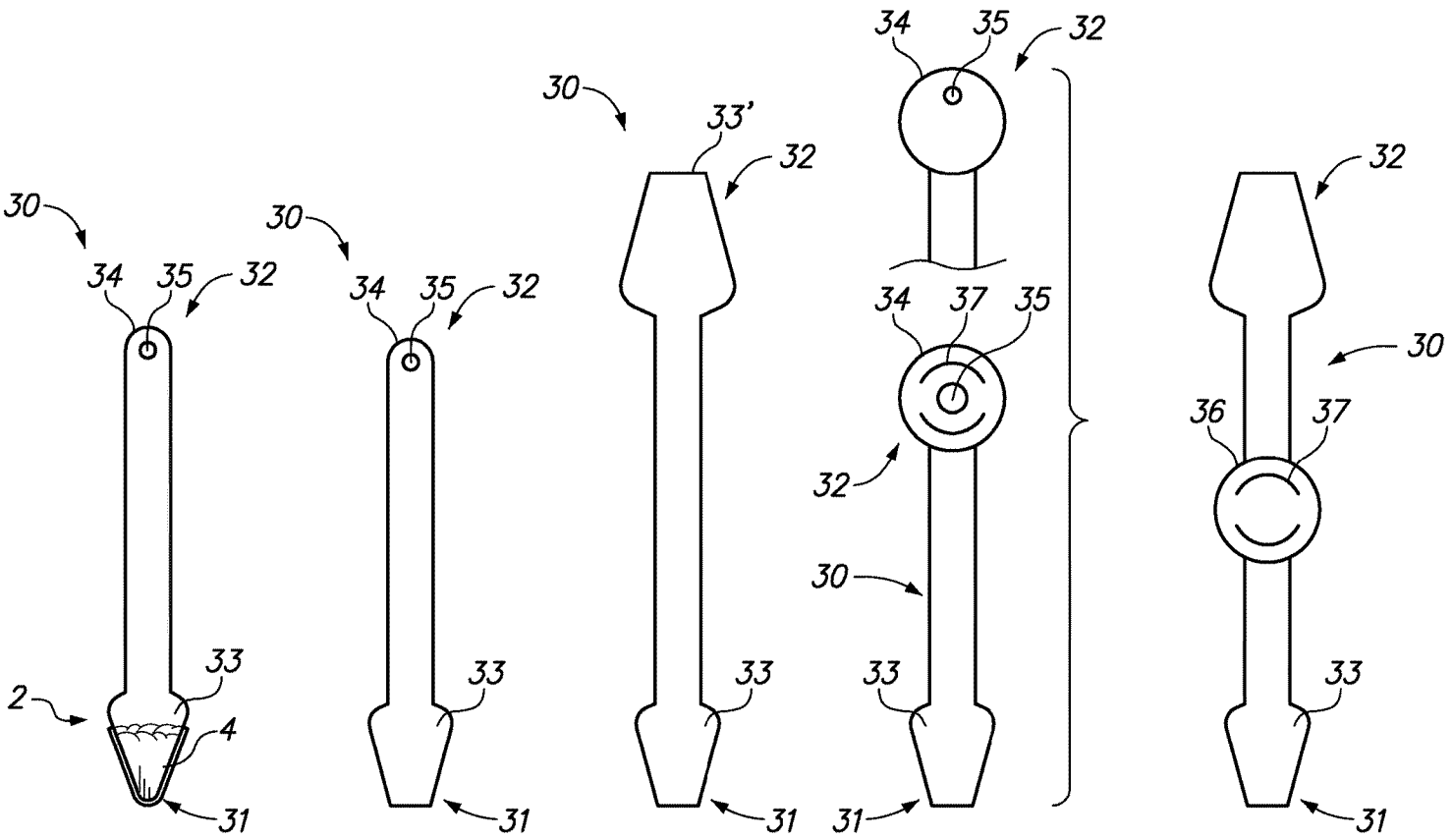
FIG. 5A depicts a front side view of an embodiment of a residue recovery tool having a V-shape with a rounded bottom scraping material in the material collecting channel of a residue removal device.
FIG. 5B depicts a front side view of an embodiment of a residue recovery tool having a V-shape with a straight bottom.
FIG. 5C depicts a front side view of an embodiment of a residue recovery tool having two recovery ends at the proximal and distal ends.
FIG. 5D depicts a front side view of an embodiment of a residue recovery tool having V-shape with a straight bottom and a circular head at the proximal end with a circular pattern imprinted on the head, and an alternative of this embodiment having a circular head at the proximal end and a notch in the circular shape.
FIG. 5E depicts a front side view of an embodiment of a residue recovery tool having two recovery ends at the proximal and distal ends and a centrally located circular shape.

FIG. 5A shows an embodiment of residue recovery tool 30 scraping material in the material collecting channel 4 of the device 1. The recovery end 33 of the residue recovery tool 30 shown in FIG. 5A has a V-shape with a rounded bottom and is substantially the same size as the channel 4 of the receptacle 2 having a cross-sectional V-shape with a rounded bottom. FIG. 5B shows an embodiment of residue recovery tool 30 having a V-shape with a straight bottom.

FIG. 5C shows an embodiment of a residue recovery tool 30 comprising a recovery end 33 at the distal end 31 and further comprising another recovery end 33' at the proximal end 32, the recovery end 33' having a different size than the recovery end 33 at the distal end 31. In this embodiment, the residue recovery tool 30 can be used with two different sizes of material collecting channels. In some embodiments, when the residue recovery tool 30 comprises a recovery end 33 at the distal end 31 and further comprises another recovery end 33' at the proximal end 32, the residue recovery tool 30 further comprises a circular shape 36 comprising a circular or semicircular pattern 37 drawn or etched thereon, which both guide the user while selecting a receptacle 2 appropriate for a given vessel size. The circular shape 36 may be anywhere along the length of the recovery tool 30. In a preferred embodiment shown in FIG. 5E, the circular shape 36 is centrally located on the recovery tool 30.

In one embodiment shown in FIGS. 5A, 5B, and 5D, the residue recovery tool 30 comprises a handle 34 at the proximal end 32. When the residue recovery tool 30 comprises a handle 34 at the proximal end 32, the handle 34 may comprise an opening or notch 35 to permit storage of the tool 30. Preferably, the proximal end 32 further comprises a circular shape 36 at the proximal end 32, the circular shape 36 comprising an opening or notch 35 for storage (FIG. 5D). In addition to comprising an opening or notch 35, the proximal end 32 may comprise a circular or semicircular pattern 37 drawn or etched thereon to guide the user while selecting a receptacle 2 appropriate for a given vessel size.

In certain embodiments when the residue removal device 1 and the residue recovery tool 30 comprise a circular or semicircular pattern 27, 37 drawn or etched thereon, the circular or semicircular patterns 27 and 37 are similar and aesthetically connect the residue removal device 1 and the residue recovery tool 30. The circular or semicircular pattern 37 and circular shape 36 on the removal tool geometrically connect to one another as well as to the circular opening of a vessel.

Figure 6:
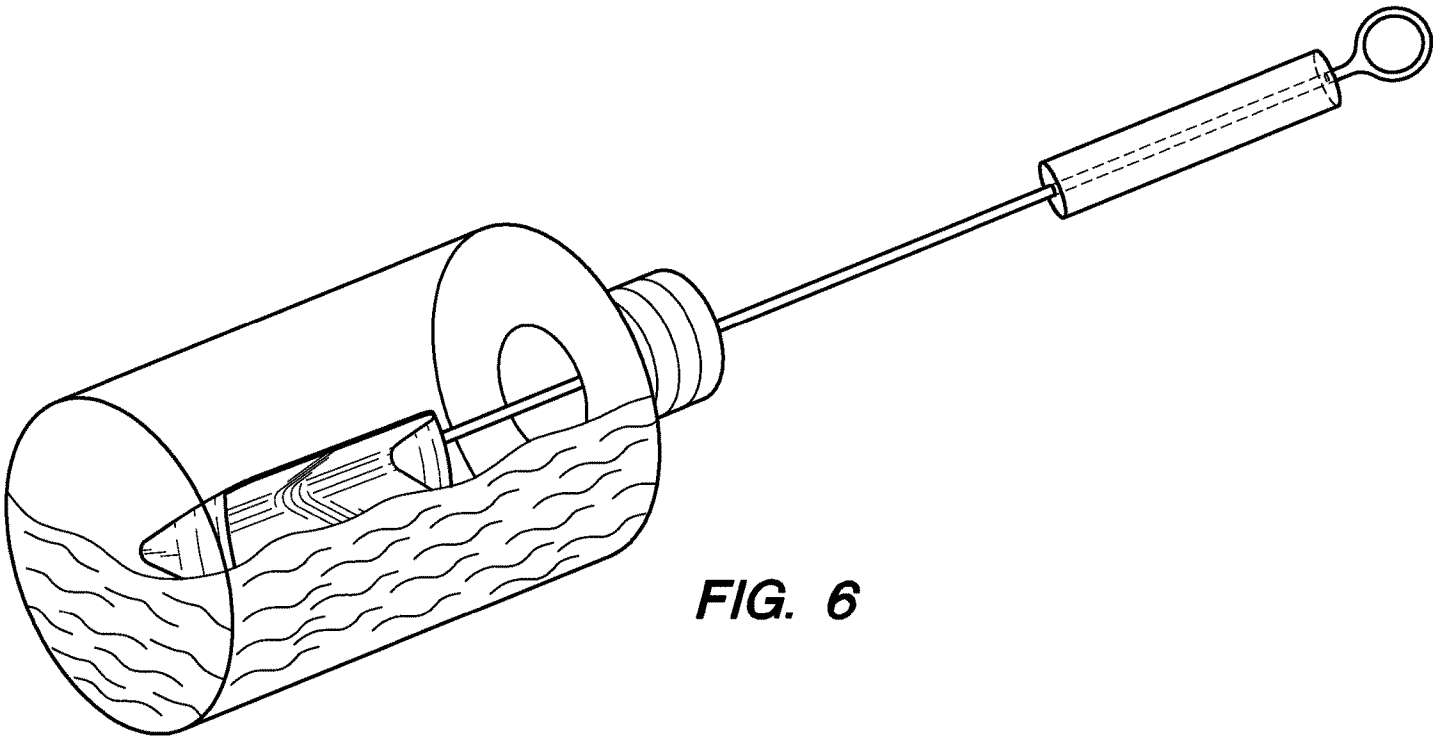
FIG. 6 depicts a perspective view illustrating utilization of an embodiment of a residue recovery tool in a narrow necked vessel.

Now referring to FIG. 6, an embodiment of the residue removal device is shown inserted into a narrow necked vessel to illustrate utilization of the residue removal tool. In short, the tool is inserted through the narrow neck of the vessel as shown and is manipulated such that one of the flexible sidewalls of the material collecting channel is pressed against the inside surface of the vessel to be dragged along the inside surface of the vessel to scrape and collect material caught on the inside surface of the vessel.

In certain aspects, there is provided a residue removal kit. The residue removal kit comprises a plurality of receptacles of varying configurations, a plurality of shafts of varying configurations, wherein the receptacles and the shafts can be removably and interchangeably connected to each other to provide a plurality of residue removal devices suitable for use with vessels of varying sizes, shapes, and openings. The receptacles, shafts, and means of removably connecting the receptacles and the shafts are as described above. The residue removal kit may further comprise a plurality of residue recovery tools of varying configurations. The residue recovery tools are as described above.

What is claimed is:

1. A residue removal device for extracting leftover material from a vessel, the device comprising:

a. a receptacle adapted for collecting material from sides and bottom of a vessel, the receptacle comprising a material collecting channel formed by two side walls connected along a base at an angle, an open top, an open, planar distal end, and a planar end wall at the proximal end of the material collecting channel; and b. an elongated shaft having a proximal end and a distal end, wherein the distal end of the shaft is connected to the base of the receptacle and offset in a first direction from the proximal end of the shaft, and the open top is offset from the base of the receptacle in the first direction, wherein the offset of the distal end of the shaft from the proximal end of the shaft is a distance approximately 90 to 110% of the depth of the receptacle and the proximal end of the shaft is approximately parallel to the base of the receptacle;

wherein said device is adapted for removing material residue in a narrow necked vessel.

2. The device of claim 1, wherein the receptacle has rounded corners.

3. The device of claim 1, wherein the material collecting channel has a shape selected from a semi-circle, a semi-oval, a U-shape, a V-shape, a V-shape wherein the base is flat, a U-shape wherein the base is flat, a modified D-shape, and an open wedge shape wherein the two side walls are slanted.

4. The device of claim 1, wherein at least one side wall of the receptacle is adapted to be placed against, and dragged along the inside surface of a vessel to collect material caught on the inside surface of the vessel.

5. The device of claim 1, wherein a top edge of at least one side wall of the receptacle is flexible and resilient.

6. The device of claim 1, wherein the receptacle is made of at least one of plastic, rubber, silicone, polyethylene, propylene, metal, alloy, shape memory alloy, and combinations thereof.

7. The device of claim 1, wherein at least a portion of the shaft is straight.

8. The device of claim 1, wherein the shaft is extended by means of one or more connectable sections.

9. The device of claim 1, wherein the shaft is flexible.

10. The device of claim 1, wherein the shaft comprises a user-bendable section.

11. The device of claim 1, wherein the shaft comprises a handle on the proximal end.

12. The device of claim 11, wherein the handle comprises at least one of a circular and semicircular pattern thereon.

13. The device of claim 1, wherein the proximal end of the shaft comprises at least one of an opening, a notch, and a ring-shaped attachment for storage of the device.

14. The device of claim 1, wherein the shaft is fixedly connected to the receptacle.

15. The device of claim 1, wherein the shaft is removably connected to the receptacle.

16. The device of claim 15, wherein the shaft comprises coupling means for removably connecting the shaft to the receptacle.

17. A residue removal device according to claim 1 further comprising a residue recovery tool, wherein the residue recovery tool is an elongated member with a distal end and a proximal end, wherein the tool comprises a recovery end at the distal end, and wherein the recovery end has a size and shape substantially complementary to the cross-sectional size and shape of a material collecting channel in the residue removal device.

18. The device of claim 17, wherein the recovery tool further comprises a recovery end at the proximal end having a different shape and size than the recovery end at the distal end.

19. The device of claim 17, wherein the recovery tool comprises a handle at the proximal end.

20. The device of claim 17, wherein the recovery tool comprises a handle comprising an opening or notch for storage of the tool.

21. The device of claim 17, wherein the recovery tool further comprises a circular shape having at least one of a circular and semicircular pattern thereon to guide the selection of an appropriately sized receptacle.

22. A residue removal kit according to claim 17 for extracting leftover material from a vessel, the kit comprising:

a. a plurality of residue removal devices, wherein the residue removal devices have varying sizes; and b. a plurality of residue recovery tools.

23. The device of claim 1, wherein the shaft is rigid.

* * * * *